US005144755A

United States Patent [19]

Braun et al.

[11] Patent Number: 5,144,755

[45] Date of Patent: Sep. 8, 1992

[54] GRAIN DRYER CONTROL SYSTEM AND METHOD USING MOISTURE SENSOR

[75] Inventors: Keith Braun, Northwood; Larry Stille, Rockford, both of Iowa; Dennis Brumwell, Bloomington, Minn.

[73] Assignee: David Manufacturing Company, Mason City, Iowa

[21] Appl. No.: 803,751

[22] Filed: Dec. 4, 1991

Related U.S. Application Data

[63] Continuation of Ser. No. 509,999, Apr. 16, 1990, abandoned, which is a continuation of Ser. No. 936,283, Dec. 1, 1986, Pat. No. 4,916,830.

[51] Int. Cl.[5] ..... F26B 13/10

[52] U.S. Cl. ..... 34/52; 34/56

[58] Field of Search ..... 34/52, 48, 50, 56; 324/689, 658, 664; 307/118

[56] References Cited

U.S. PATENT DOCUMENTS

| | | | |
|---|---|---|---|
| 2,858,620 | 11/1958 | Naylor . | |
| 3,152,873 | 10/1964 | Wright | 34/52 |
| 3,271,878 | 9/1966 | Martin . | |
| 3,400,468 | 9/1968 | Mathews . | |
| 3,404,467 | 10/1968 | Burghard . | |
| 3,429,053 | 2/1969 | Behlen et al. . | |
| 3,470,626 | 10/1969 | Pfeiffer . | |
| 3,599,343 | 8/1971 | Nielsen | 34/52 |
| 3,606,745 | 9/1971 | Girodat . | |
| 3,636,638 | 1/1972 | Noyes . | |
| 3,714,718 | 2/1973 | Sukup . | |
| 3,732,435 | 5/1973 | Strandberg et al. | 34/52 X |
| 3,736,667 | 6/1973 | McClaren . | |
| 3,765,100 | 10/1973 | Heidtmann . | |
| 3,946,496 | 3/1976 | Sukup . | |
| 4,068,223 | 1/1978 | Steffen . | |
| 4,152,840 | 5/1979 | Stille . | |
| 4,168,466 | 9/1979 | Boldt . | |
| 4,403,191 | 9/1983 | Satake . | |
| 4,425,937 | 7/1985 | Strandberg, Jr. et al. . | |
| 4,530,167 | 7/1985 | Hotovy . | |
| 4,546,725 | 10/1985 | Oetiker et al. . | |
| 4,599,809 | 7/1986 | Parkes . | |
| 4,750,273 | 6/1988 | Parkes et al. . | |
| 4,765,190 | 8/1988 | Strubbe . | |
| 4,898,092 | 2/1990 | Greer . | |
| 4,916,830 | 4/1990 | Braun et al. | 34/48 |

OTHER PUBLICATIONS

MCS/101 Brochure from Moisture Control Systems, Inc. undated.

MoistureTrac Brochure from Shivvers, Inc., undated, with accompanying letter from Shivvers dated Sep. 15, 1989.

American Society of Agricultural Engineers, Paper No. 85-3529 entitled "Acoustic Properties of Flowing Wheat", Andreas Harrenstein and Gerald H. Brueswitz, for presentation at the 1985 Winter Meeting dated Dec. 17-20, 1985.

The COMPU-DRY System: Moisture Measuring and Control Equipment for Vertical Drying Plants, Eco--Line Products, Inc.

COMPU-DRY, Shivvers Brochure, copyright Jan. 1985.

Moisture Monitor System Instruction Manual, Moisture Control Systems, Inc.

MCS 201 New Generation Analog Moisture System, Moisture Control Systems, Inc.

MCS 405 MT Transducer Specifications, Moisture Control System, Inc.

MCS 401 8 Channel Monitor, Moisture Control Systems, Inc.

AUTO DRY The Grain Brain, Sukup Brochure.

Gravity Pipe Sampling Concept drawing, Moisture Control Systems, Inc. Jul. 31, 1979.

Bin Sampling Concept drawing, Moisture Control Systems, Inc. Jul. 30, 1979.

Direct Transducer Mounting Concept drawing, Moisture Control Systems, Inc. Aug. 6, 1979.

Auger Sampling Concept drawing, Moisture Control Systems, Inc. Jul. 30, 1979.

*Primary Examiner*—Henry A. Bennet

*Attorney, Agent, or Firm*—Merchant, Gould, Smith, Edell, Welter & Schmidt

[57] ABSTRACT

A control system for a drying system of the type including a drying bin. Discharge particulate material moisture sensing means including a sensor assembly positioned in a discharge auger for sensing the moisture content of the particulate material. Control means is connected to the discharge particulate moisture sensing means and the discharge auger for controlling operation of the discharge auger.

19 Claims, 13 Drawing Sheets

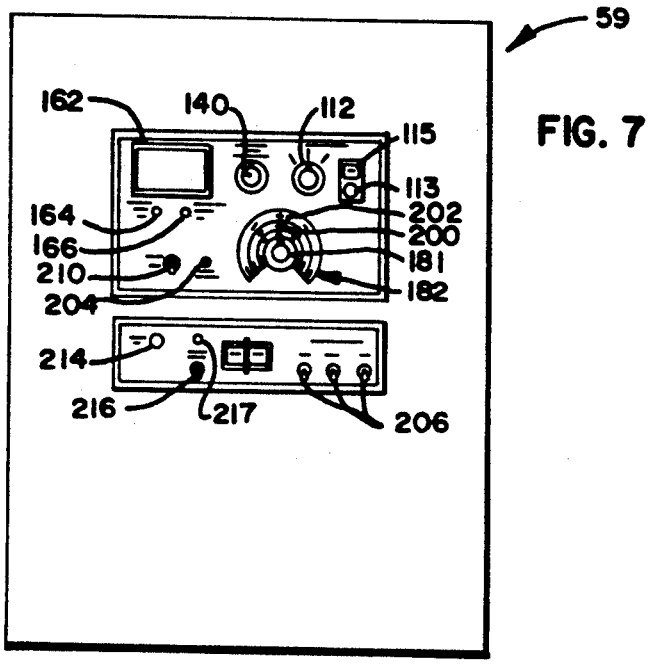
FIG. 7
FIG. 2
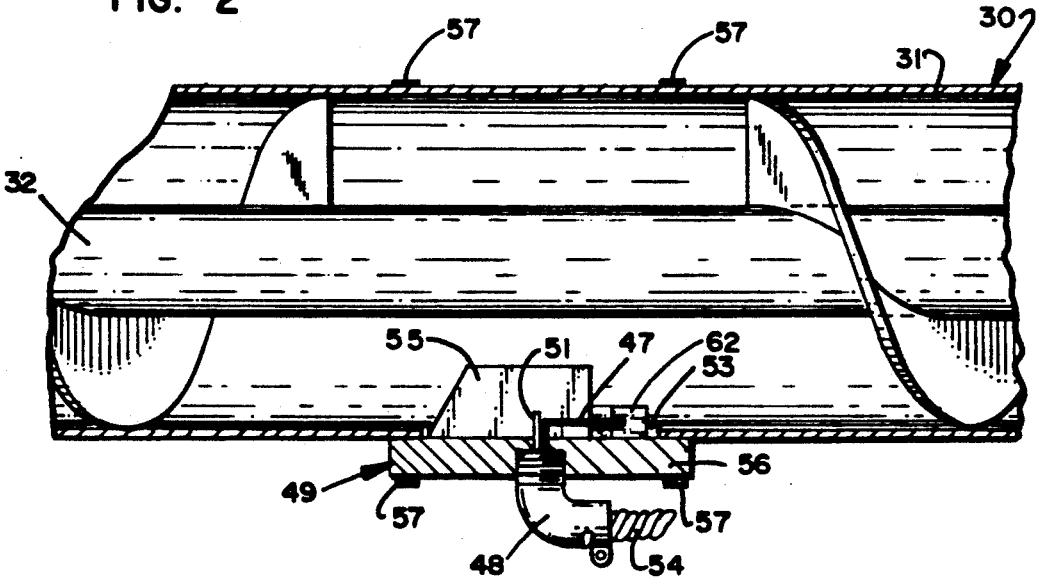

GRAIN DRYER CONTROL SYSTEM AND METHOD USING MOISTURE SENSOR

This is a continuation of application Ser. No. 07/509,999, filed Apr. 16, 1990, abandoned which was a continuation of application Ser. No. 07/936,283, filed on Dec. 1, 1986, which issued as U.S. Pat. No. 4,916,830 on Apr. 17, 1990.

BACKGROUND OF THE INVENTION

The present invention relates generally to the field of drying systems for agricultural grains and other particulate materials. More particularly, the present invention relates to a drying control system and method which uses a moisture sensor. The present invention is specifically described with respect to the drying of agricultural grain, but the principles involved are also applicable to other particulate materials.

A grain dryer typically consists of a bin or chamber with an apertured floor. Grain is placed in the bin and warm dry air is forced up through the apertured floor. The air circulates around the grain particles, working its way up through the grain in the bin. In doing so, the air warms the grain and absorbs some of its moisture, and in turn, the air is cooled and becomes moisture laden. In this manner, drying proceeds upwardly in zones through the drying bin until the desired lower level of moisture content is attained. Periodically, as the grain is being dried, the warmest and driest layers from the bottom of the drying bin are drawn off or removed for storage or shipment. The method of removal is usually powered augers, namely, sweep augers, discharge augers and transfer augers. The speed and/or continuity of operation of the sweep and discharge augers determines the rate at which the grain or other particulate material moves through the drying bin, and, inversely, the length of time during which the grain is exposed to the drying action of the warm dry air. A transfer auger transfers grain from the discharge auger to a storage bin.

Because the drying process can proceed at different rates, depending upon the moisture content of the grain, ambient air temperature and humidity, and the intensity of the applied heat, it is necessary to provide some type of control system. Generally, it is convenient to allow the air heating and circulating equipment to operate according to its optimum design characteristics, and to control the overall drying by controlling the removal rate of the dried grain from the bottom of the bin. This, in turn, is done by controlling the sweep and discharge augers periodically according to a preset timer, intermittently according to sensed temperature or moisture, or by a combination of both.

The prior art has many types of sensing systems for sensing humidity or temperature of the grain or air at a selected zone. One type of system uses a sensing element placed at a point around the periphery of the drying bin at a preselected elevation above the floor. However, this type of system has certain inherent disadvantages because its operation depends on the assumption that uniform drying occurs at equal elevations above the floor. However, in practice there may be wet spots or zones which may be missed by this type of sensor. Other types of sensors are mounted at the discharge auger from the bin for sampling the moisture content or temperature of the grain being discharged or air escaping therefrom. Often in these types of systems, the motor for the sweep and discharge augers is started periodically by a timer, then remains in motion until the temperature or wetness of the grain can be sampled at the discharge. If the grain has too high of a moisture content, the discharge mechanism is stopped to await another predetermined time interval while the drying apparatus continues in operation.

U.S. Pat. No. 3,714,718 discloses a moisture sensor near the grain discharge outlet and seems to imply that it does not require periodic sampling, since it measures the moisture in the air which continuously escapes past the moisture sensor. In addition to other problems, there is the problem of variations in signal due to numerous environmental and system factors thereby reducing the accuracy of the system. Moreover, there is the problem that the sensor senses the moisture level of the air and not the grain itself, which provides a less accurate measurement of the moisture content in the grain, than sensing the grain itself. Additionally, there is a potential problem of rapid on/off switching.

U.S. Pat. No. 4,599,809 also disclosed a grain moisture sensing system. This system receives a grain sample from the grain unloaders and conveys the sample to a capacitive sample cell where a meter senses the moisture content as a function of the dielectric constant of the sample in the cell. Some of the disadvantages of this system are that the moisture of the grain is only periodically sensed and a separate sampling cell is needed to do so.

Commonly assigned patent, U.S. Pat. No. 4,152,840, hereby incorporated by reference, disclosed a sensing system wherein a predry sensor is mounted inside the grain drying bin and a discharge grain temperature sensor is mounted in the discharge auger to measure the temperature of the grain in the discharge auger. While this approach offers many advantages over the prior art, the present invention offers even further advantages over existing grain drying systems.

SUMMARY OF THE INVENTION

The present invention relates to a control system for a grain drying system of the type which includes a drying bin, or other form of drying chamber, means for circulating drying air therethrough, and a discharge auger for removing dried grain from the drying bin. The control system includes discharge grain moisture sensing means for sensing the moisture content of the grain in the discharge auger, the discharge grain moisture sensing means including crystal oscillator means for driving capacitor means, the capacitance of the capacitor means being sensitive to changes in the moisture content of the grain, the capacitor means providing an output voltage corresponding to the capacitance of the capacitor means. Control means is connected to the discharge grain moisture sensing means and the discharge auger for periodically starting the discharge auger to remove grain from the drying bin, or other form of drying chamber and for stopping the discharge auger if the discharge grain moisture sensing means indicates that the grain is above a predetermined moisture level.

A preferred embodiment of the present invention includes a crystal oscillator for driving the capacitor means, thereby providing increased frequency stability at all temperatures.

In the preferred embodiment, the capacitor means includes references capacitor means and sensor capacitor means. Trim means is used to balance the reference and sensor capacitor means when there is no grain in the discharge auger. The sensor capacitor means is sensitive to changes in the moisture content of the grain. The reference capacitor means is not sensitive to change in the grain moisture content and reflects the capacitance of the air void of any grain. Accordingly, the difference in capacitance between the reference and sensor capacitor means will reflect the moisture content of the grain itself and not the air.

Also in the preferred embodiment of the invention, the output voltage of the capacitor means is amplified proximate the sensor location so as to reduce interference or distortion of the signals when transmitted to a remote location.

The preferred embodiment includes built-in static protection and a precision voltage regulator.

The control means of the present invention preferably provides for averaging of the moisture readout by providing double filtration of the voltage signal.

The preferred embodiment is capable of operating in a range of temperature extremes; e.g., −30 to 180 degrees Fahrenheit.

Another feature of the present invention is the provision of a control panel providing various user controls for operation of the system.

Still another feature of a preferred embodiment is the provision of a manual moisture offset control such that factory-set moisture offset can be manually modified at a control panel.

Yet another feature of a preferred embodiment of the present invention is that it provides for periodic sampling of the grain moisture content of the grain being removed from the drying bin, the frequency of sampling being adjustable, e.g., from 15 to 60 minutes. Moreover, the control means preferably provides for automatic increase of the drying time between samplings; e.g., double or triple, as conditions require to achieve efficient drying of the grain.

These and various other advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views;

FIG. 2 is a sectional view illustrating positioning of an embodiment of a sensor blade in the discharge auger assembly in accordance with the principles of the present invention;

FIG. 7 is a plan view of a control panel in accordance with the principles of the present invention.

DETAILED DESCRIPTION OF A PREFERRED EMBODIMENT

Figure 1:
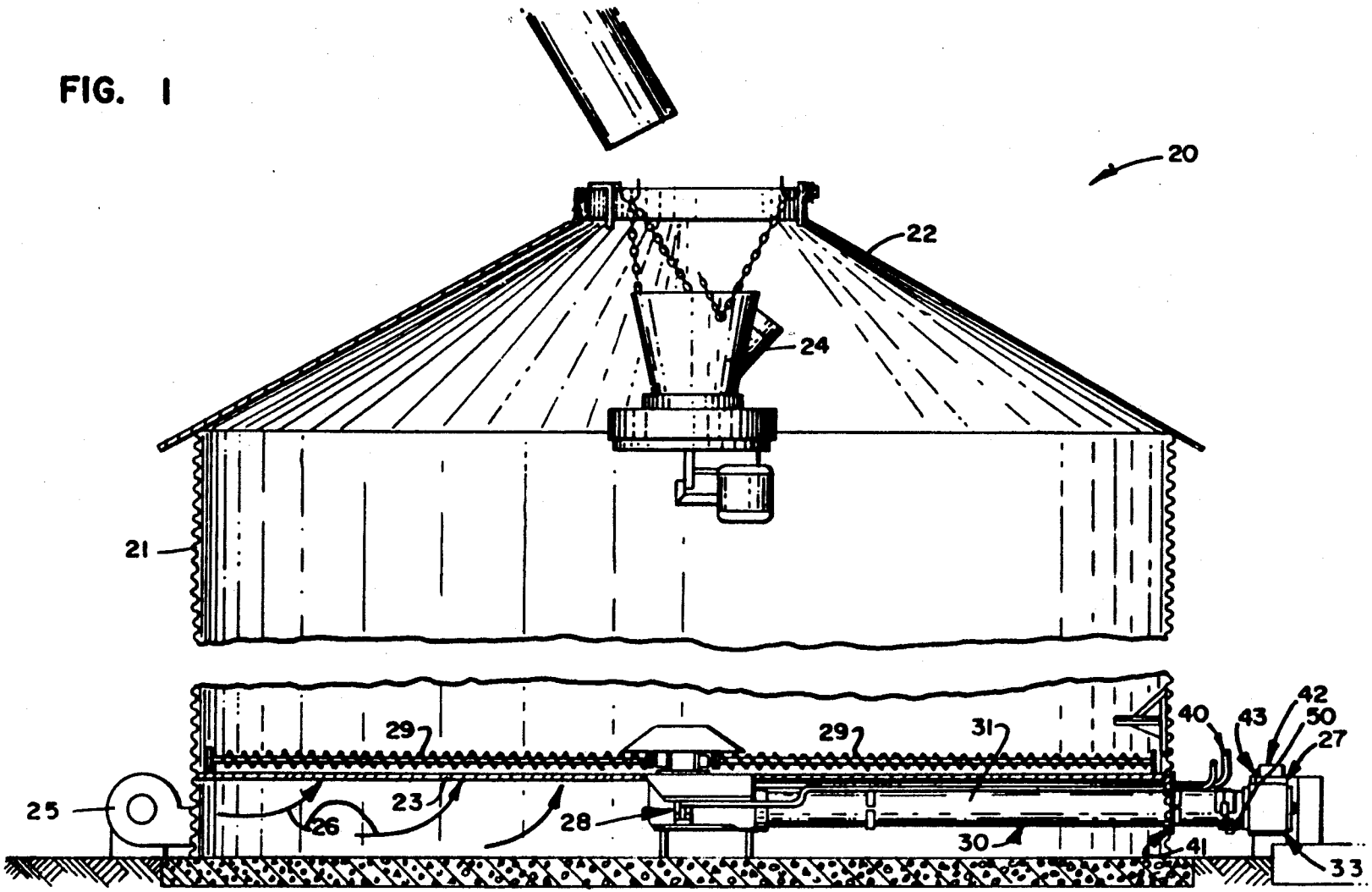
FIG. 1 is a perspective view of a grain drying bin using an embodiment of the present invention.

Illustrated in FIG. 1 is a grain drying bin, generally designated by the reference numeral 20, of the general type to which the present invention may be advantageously applied. The bin 20 comprises a cylindrical wall 21, a conical roof 22, and a floor 23 having a plurality of air flow apertures therein. A distributor assembly may be provided as at 24 for loading grain to be dried into the bin 20.

Reference numeral 25 generally designates a dryer assembly which provides a circulation of heated air as indicated by arrows 26, to the underside of the floor 23. The heated air then circulates up through the floor 23 and around the grain kernels toward the top of the bin 20. The driest and warmest zone of the grain is thus the bottom layer within the bin 20.

A plurality of sweep augers 29 may be provided. A motor 27 driving through a suitable power transmission generally indicated by the reference numeral 28 provides the force to operate the sweep augers 29, while rotating them around the floor area of the bin 20. In this matter, the lower layer of the dried grain is swept inwardly to the center, where it drops down to the discharge auger assembly, which in FIG. 1 is generally designated by the reference numeral 30. This assembly includes a discharge tube 31 and the discharge auger 32 shown in FIG. 2. The discharge auger assembly 30 extends from the center of the bin 20 beneath the floor 23, where the sweep augers 29 deliver the dried grain from the outside wall of the bin to a discharge end designated in FIG. 1 by the reference numeral 33, and shown in greater detail in FIG. 2. Also shown in FIGS. 1 and 2 is a sensor assembly 49 of a sensor system 50 mounted beneath the discharge tube 31, on the outside of the bin 20, near the discharge end 33 of the discharge tube assembly 30.

Referring to FIG. 2, the part of the discharge auger assembly 30 near the discharge end 33 is shown in greater detail. The discharge auger tube 31 extends outwardly through a clearance hole provided for that purpose from the wall 21 of the bin 20. A portion of the discharge auger tube 31 is broken away in FIG. 2 for showing components positioned inside thereof.

A control rod 40 extends through the bin wall 21, parallel to and slightly above the discharge auger tube 31. The control rod 40 extends to a slide gate in the floor 23 near the center of the bin 20 for controlling delivery of the grain as is generally known. A mounting plate 41 is positioned on the discharge auger tube 31 at the bin wall, and has an aperture through the which the control rod 40 passes. A cover 42 may be provided at the top of the discharge tube 31. The cover may be hinged as at hinge 43 to allow the cover to open when grain is forced against it in an overload situation. Although not shown, an auger overload switch as is generally known mounted to the cover 42 which responds to the angular position of the cover 42 for stopping the discharge should a transfer auger which transfers away the grain become overloaded. Grain is normally discharged out of open discharge end 33.

As seen in FIG. 2, a slot 53 is provided in the underside of the wall of the discharge auger tube 31, with the long extension of the slot being aligned with the axis of the discharge auger tube 31. A moisture sensor blade member 55 of the sensor assembly 49 is mounted in the discharge auger tube 31 so that the blade 55 extends through the slot 53 into the interior of the discharge auger tube 31. A gap is provided in the flighting of the discharge auger 32 in order to provide a clearance for the sensor blade 55 which is a substantially flat piece of metal extending longitudinally of the discharge auger tube 31. The gap is provided by removing a portion of the flighting from the discharge auger 32. The moisture sensor blade 55, also referred to as a moisture contact member or a vane member, is suitably mounted on the discharge auger tube 31 by a member 56 suitably fastened thereto by straps 57 or the like. Temperature sensor blade 62 is also mounted on discharge auger tube 31 by member 56. The moisture sensor blade 55 and temperature sensor blade 62 are interconnected by electrical conductors 51 and 47, respectively, to a sensor system housing 52 attached to the bin but not shown in the Figures, where other elements of the sensor system 50 are housed, including sensor circuitry. The conductors 51 and 47 are shown enclosed in conduit 54 so as to protect them from the elements and elbow fitting 48 connects the conduit 54 to the member 56.

Figure 3:
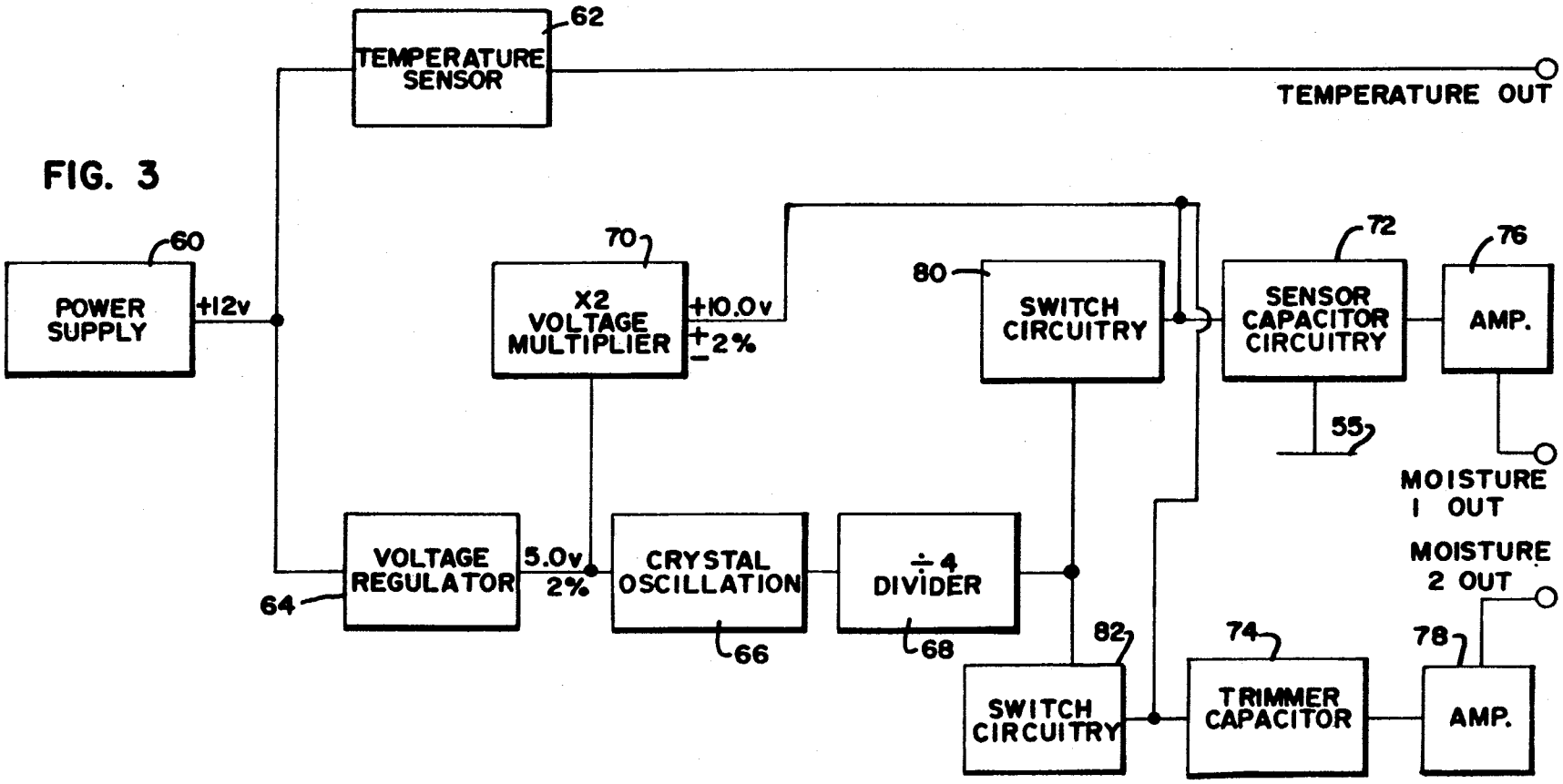
FIG. 3 is a block diagram of a sensor system in accordance with the principles of the present invention.
Figure 4:
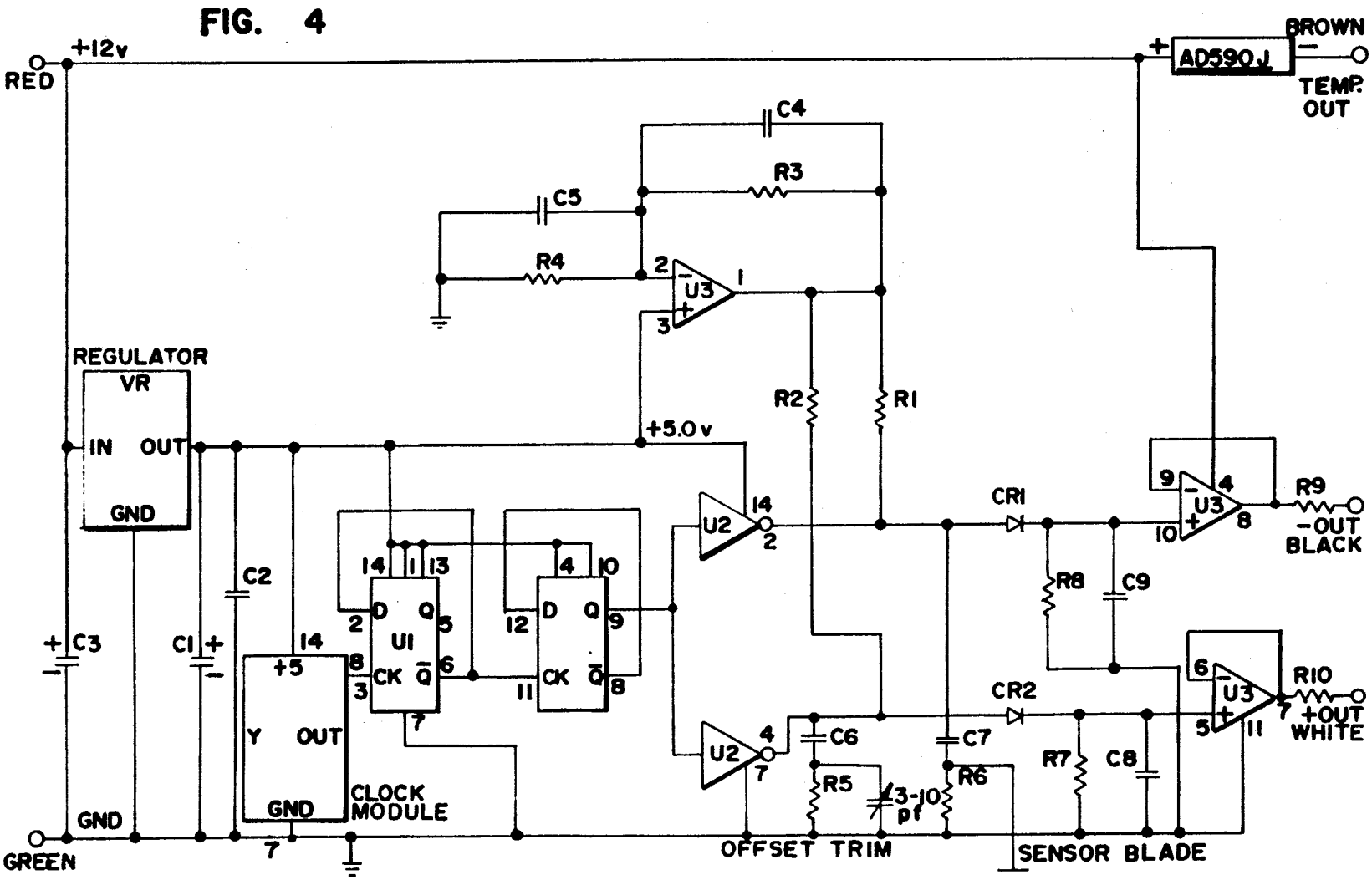
FIG. 4 is a schematic diagram of an embodiment of a sensor system in accordance with the principles of the present invention.

Referring now to FIGS. 3 and 4, a preferred embodiment of the sensor system 50 will now be described. The basic function of the sensor system 50 is to convert the grain moisture content of the grain into an electrical signal which can be displayed at a control panel 59 of a control housing 58 housing control circuitry for the sensor system. Preferably, the control housing 58 and its associated control panel 59 will be mounted outside the bin. The sensor system works by using the sensor blade 55 as a capacitor whose capacitance varies with changes in the moisture content of the grain. The sensor system 50 provides an output voltage corresponding to the capacitance of the sensor blade 55 and thus, to the moisture content of the grain. While the capacitance of the sensor blade will vary with the moisture content of the grain, the changes in electrical capacitance involved are very small and therefore the sensor system 50 has to be extremely sensitive. Moreover, the sensor system must not be sensitive to changes in the temperature and moisture of the ambient air. As illustrated in FIGS. 3 and 4, the sensor system 50 is interconnected to a power supply 60 which in turn is interconnected to a temperature sensor 62 located on member 56 which converts temperature into a current representative of the temperature as is generally known. The power supply 60 is interconnected to a voltage regulator 64 which converts the 12-volt input from the power supply 60 into a well-regulated 5.0 volts for the other components of the sensor system 50. The output of the voltage regulator 64 is interconnected to a 4-megahertz ($MH_z$) crystal oscillator 66 which produces a 4 megahertz ($MH_z$) output. The 4 megahertz ($MH_z$) output of the crystal oscillator 66 is interconnected to a divider 68 which converts the output to a 1 megahertz ($MH_z$) signal. The output of the voltage regulator 64 is also interconnected to a voltage multiplier 70 which multiplies the 5.0 volt reference output by two, such that the output is set at 10.0 volts. The 10.0 volt output is interconnected to sensor capacitor circuitry 72 which is interconnected to the sensor blade 55, also referred to as a vane or plate member, mounted in the discharge auger assembly 30. The 10.0 volt output is also interconnected to trimmer capacitor circuitry 74. The trimmer capacitor circuitry 74 is adjustable to evenly balance the output voltage of the sensor capacitor circuitry 72 and the trimmer capacitor circuitry 74 when there is no grain present in the discharge auger assembly 30. Both of the outputs are amplified by amplifier circuitry 76 and 78, respectively, their outputs being labeled Moisture 1 and Moisture 2, respectively. Switch circuitry 80 and 82 are high quality switches to ground for sensor capacitor circuitry 72 and trimmer capacitor circuitry 74, respectively.

As previously indicated, the sensor system 50 works by sensing electrical capacitance on the sensor blade 55 which projects into the grain being discharged in the discharge auger assembly 30. Near the top of the embodiment of the sensor system 50 illustrated in FIG. 4, is a power rail held at +12 volts which is input from the power supply 60 which is located at a remote location. The temperature sensor 62 provides an output voltage proportional to absolute temperature; i.e., Kelvin temperature. Later on, the system will provide for conversion of the Kelvin temperature to Fahrenheit temperature at the control housing 58. The voltage regulator 64 is shown as being a series voltage regulator which converts the 12 volt main power input into a well-regulated 5.0 volt power supply for the system. The regulator shown ideally maintains a two percent regulation in order to facilitate the precision of the sensor system 50. The capacitors C1, C2, and C3 are used to store energy, to filter out high frequency interference, and to keep the voltage regulator 64 from oscillating. A 4 megahertz ($MH_z$) crystal oscillator clock module is utilized in conjunction with a pair of D flipflops which functions as the divider 68 so as to reduce the 4 megahertz ($MH_z$) clock signal from the crystal oscillator 66 to a 1 megahertz ($MH_z$) signal thereby assuring that the duty cycle of the square wave is exactly 50 percent. An operational amplifier U3 in conjunction with a pair of resistor capacitor combinations in series provides the voltage multiplier function 70. Ideally, the voltage output from the voltage multiplier 70 is controlled within + or −2 percent as with the voltage regulator 64.

U2 is a 7406 converter pair driven by the 1 megahertz ($MH_z$) signal. The inverter outputs feed a pair of diodes CR1 and CR2 as well as operational amplifiers U3. The diodes serve as peak detectors for the signal, the idea being that all temperature and component type variations in either signal path will track each other and the only difference between the two signals going out as the Moisture 1 and Moisture 2 signals will be proportional to the difference in capacitance at the two capacitance measurement nodes.

The inverters function as switches to ground. It will be appreciated that if a switch could be built which opened and closed at 1 megahertz ($MH_z$) for each of the two inverters, it would perform the same function. The inverters function as a high-quality switch to ground and the basic operation for measuring capacitance on the outputs of these two inverters is to have the inverters pull up resistors R2 and R1 supplying current to charge the test capacitances upwards toward 10 volts and the diodes peak-detect this wave form on to capacitors C8 and C9. Capacitor C7 is interconnected to the sensor blade 55 by a suitable electrical connector. Similarly, the capacitor C6 is interconnected to a 3 to 10 picofarad (pf) trimmer capacitor. This functions as the balancing adjustment for the bridge arrangement allowing adjustment of the 3 to 10 picofarad trimmer capacitor to be adjusted to nullify or eliminate any differences between the two channels of the sensors. Therefore, when the sensor blade 55 is measuring only the capacitance of the air, the differential voltage between the two is zero. In the embodiment shown, the trimmer capacitor is located in the sensor system housing 52. The capacitors C6 and C7 are merely AC coupling capacitors. They function to take the DC component of the ramp signal present on the inverters out of the signal present on the reference trimmer capacitor and the sensor capacitor. They function as high pass filters. The resistors R5 and R6 hold the DC potential at the sensor and the reference capacitors at ground on the average. The inverter outputs spend half of their time clamped to the ground, and during the other half of their time, they are ramping up toward some voltage which is related to the capacitance on the sensor blade and the trimmer capacitor, which are also referred to as the sensor node and the trimmer node. The more capacitance, the less voltage slew. The inverters provide a type of saw-tooth wave form at roughly 1 megahertz ($MH_z$). The diodes CR1 and CR2 peak-detect the wave forms of the inverters and extract the highest value they achieve and store that value on the capacitors C8 and C9 with the resistors R8 and R7 providing a time constant which would discharge those capacitors eventually in the event that the saw-tooth wave forms were reduced rapidly. The output of the two amplifiers U3 is the differential voltage proportional to the capacitor loading on the sensor blade 55. The sensor system 50 is extremely sensitive. For example, in some applications, the output differential is in the 100s of millivolts for a few picofarads of loading on the sensor blade 55. The amplifiers 76,78 amplify the signals such that the signals can be sent down a long cable to the control console with no loss or very little loss of signal fidelity. The transmission to the control housing 58 is fully differential and therefore, immune to some types of transmission defects going through the transmission cable. In a preferred embodiment, the transmission cable provides the ground and a power conductor to the sensor system 50 and the sensor system 50 returns a temperature-based current and two differential voltages which are related to the sensor capacitor 55.

Figure 5A:
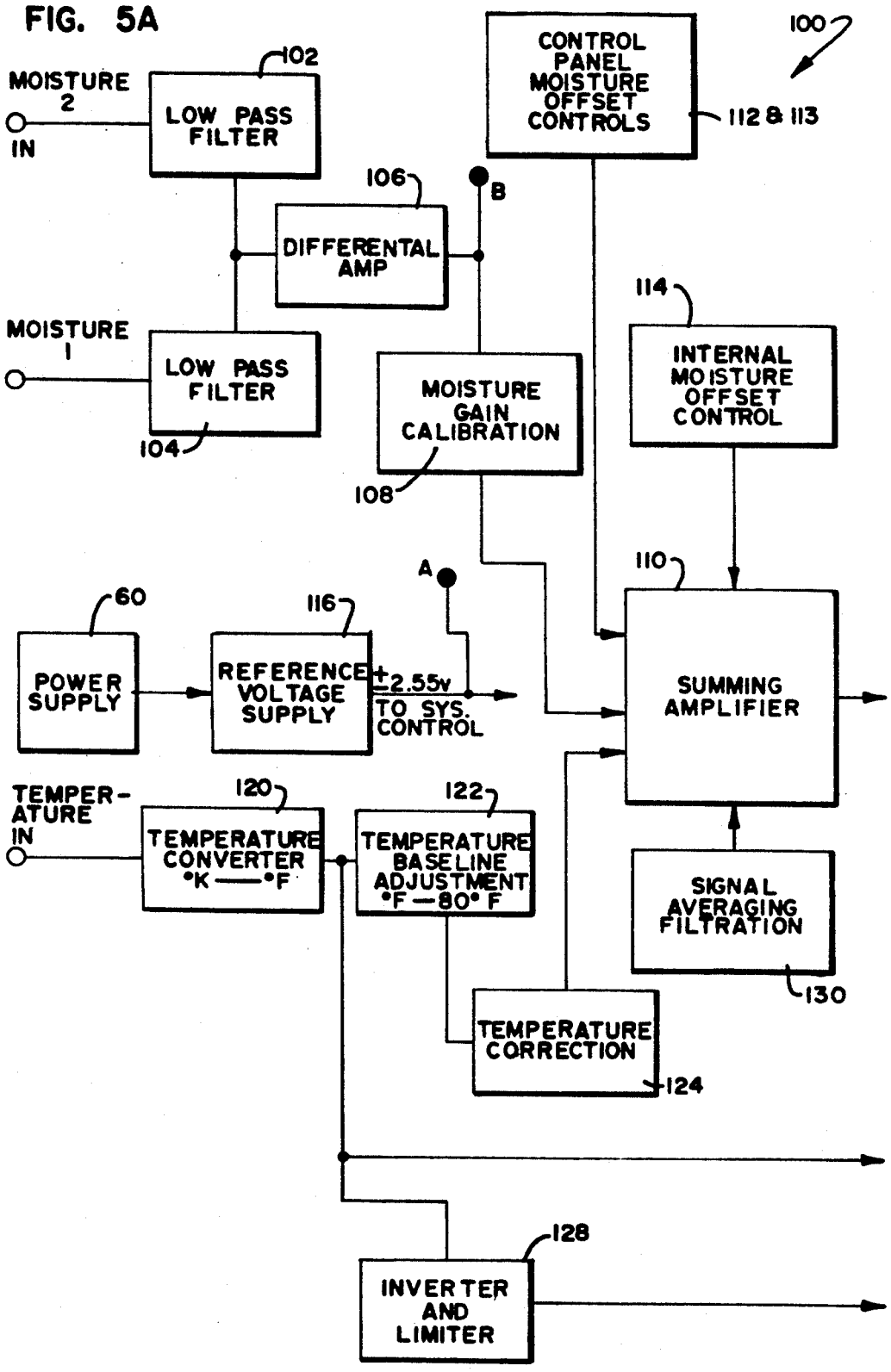
FIGS. 5A and 5B are a block diagram of a control system in accordance with the principles of the present invention.
Figure 5B:
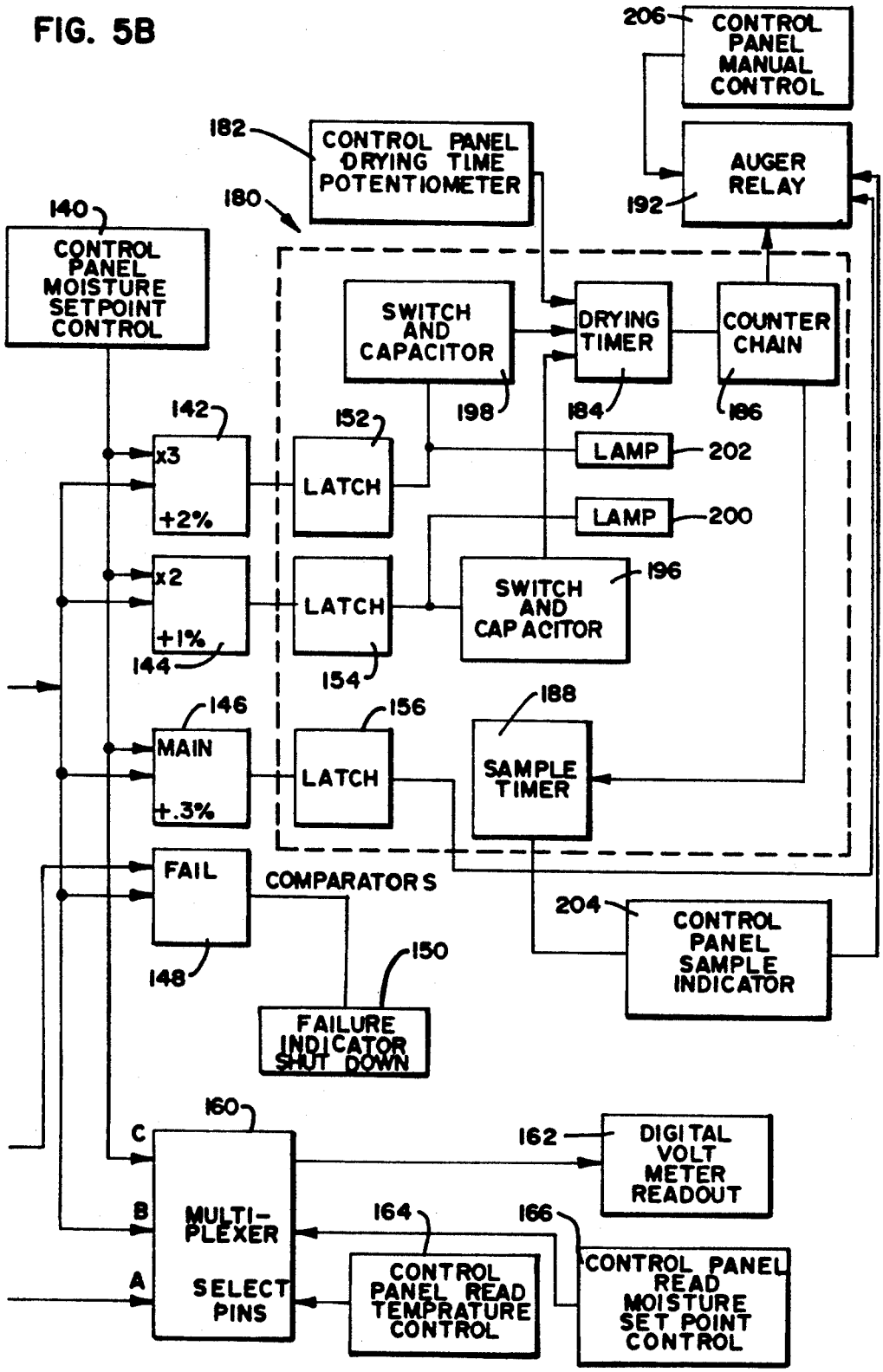

The use of a crystal oscillator in the sensor system 50 results in increased temperature stability as compared to use of an RC oscillator alternative. The accuracy of the crystal oscillator in the sensor system 50 of the present invention is important because the ramp and peak detect method of capacitance measurement relies on a precise time interval of substantially 500 nanoseconds for the clamping switches U2 to be opened. The precise formula for the voltage developed by each leg of the peak detector is:

$$V_{out}=V_{max}*(1-e^{-T/RC})-V_{diode}$$

where $V_{out}$=the output voltage $V_{max}$=the reference voltage $V_{diode}$=the voltage of the diode; and T=the time interval In the embodiment shown in FIGS. 3 and 4, a 10 volt reference voltage is used, the time interval T is determined by the crystal oscillator, and the RC time constant is formed by the pull-up resistor and the capacitance of either the sensor blade 55 or the reference trimmer capacitor. The overall system measurement is proportional to the difference between the voltages generated by the two legs of the sensor system, that is, the sensor blade and the reference trimmer capacitor such that the moisture signal at a test point B identified in FIG. 5 is described as follows:

$$V_{tpb}=10*(e^{-T/RCsensor}-e^{-T/RCreference})$$

The exponential on the right is essentially constant so that the overall transfer function has the form V=1/exp(1/RCsensor). It should be noted that the function of capacitance with grain moisture is possibly highly non-linear so that efforts to linearize the sensor transfer function (capacitance to voltage) would appear to only partially improve overall system linearity (moisture to voltage).

The offset trimmer reference capacitor controls the exponential on the right side of the equation. The intent of this adjustment is to null out the effects of all parasitic capacitances on the circuitry and the sensor blade 55 at the final assembly level and thereby drastically increase the baseline accuracy and production repeatability of the sensor. The strategy is to equalize the two exponential terms of the equation for an empty moisture sensor chamber condition. Independence from temperature variations is maximized in the balanced condition. Output is independent of the oscillator period T only when both exponentials are balanced. Errors induced by clock variation are gains rather than offsets. Ideally, buffer amplifiers will improve the long term stability of the sensor system 50. The buffer amplifiers 76,78 provide a low impedance drive to the sensor cable which should be able to overcome small amounts of current leakage from the conductors without significant loss of system accuracy. Also, if the unbuffered nodes of capacitor C8 and C9 were brought out on the cable, they would be susceptible to electromagnetic interference in the presence of strong radio frequency energy as from radio stations or the like. In the preferred embodiment, bio-polar rather than CMOS integrated circuit fabrication technology is used. The reference voltage or Vmax is closely controlled through use of a precision regulator.

Illustrated in FIGS. 5 and 6 is an embodiment of a control system 100 in accordance with the principles of the present invention. The basic function of the control system 100 is to translate the voltages coming from the sensor system 50 into meaningful information about moisture and temperature and to display these results at the control panel 59 and control the operation of the discharge auger assembly 30. As illustrated in FIG. 5, the Moisture 1 and Moisture 2 inputs from the sensor system 50 are passed through filter circuitry 102 and 104 respectively and differential amplifier circuitry 106 which remove high frequency components that have been picked up by the electrical conductor or cable during transmission of the Moisture 1 and Moisture 2 signals to the control system 100. As indicated above, the voltages of the Moisture 1 and Moisture 2 signals are roughly +5 volts. The difference in voltage between these two signals represents the relative moisture content of the grain. The output of the differential amplifier circuitry 106 is fed to moisture gain calibration circuitry 108 which adjusts gain factor, and from there the signal is transmitted to summing amplifier circuitry 110 for amplification of the voltage difference. The summing amplifier circuitry 110 difference and moisture content. Another input into the summing amplifier circuitry 110 is the control panel moisture offset controls 112 and 113 which are controls at the control panel 59 which enable the user to offset the moisture readout at the control panel 59 as displayed by the control system 100. In addition, there is an internal moisture offset control 114 which provides calibration of the system at the factory such that the control system can be set up to be as accurate as possible without requiring any user input. A reference voltage supply 116 is interconnected to the +12 volt reference supply for providing the reference voltage ±2.55 volts. The reference voltage supply 116 provides filtering and trimming functions such that a very precise ±2.55 volts can be supplied. The reference voltage supply 116 also includes an inverter function for providing a negative 2.55 volts.

More particularly, the differential amplifier circuitry 106 includes three operational amplifiers U1. The input resistors and capacitor C1 are low-pass filtration components as are C2 and C3. The objective of this filtering is to keep the high frequency components that have been picked up by the cable in transmission from the sensor out of the rest of the signal. The high frequency components are removed so that they do not have to be dealt with later on i the system. The differential amplifier circuitry 106 uses some high precision resistors to accomplish a fairly high common mode rejection. The two voltages coming in do ride somewhere off of zero volts. They are around +5 volts, and the true information contained is the difference between the two voltages. The +5 volts, however, could be varying around and the output of the differential amplifier circuitry 106 at test point B preferably does not show any of that common node information. The differential amplifier feeds a potentiometer labeled moisture gain calibration, a jumper wire and a resistor. The basic function being to adjust gain factor. How much effect the voltage difference of the input signals has on the main moisture indication is determined by the summing amplifier U3. The summing amplifier includes a summing junction which sits at a virtual ground. The summing junction is fed by several other signals. One of these signals being from the control panel offset controls 112 and 113 which as previously discussed is the user-variable offset into the moisture reading. Should the control system show a fixed error from other types of grain moisture measurement which are more important to the user, then the user can offset to correct for these errors. This circuitry is located on U1. The capacitor C4 is present for noise filtration. R11 is the calibration resistor for the control panel offset control 112. As previously indicated, an internal offset calibration 114 including a potentiometer R7 which sits between + and − the 2½ volt references is provided as a factory calibration to set up the control system to be as accurate as possible without any user corrections.

As illustrated further in 6A, to the left center of the schematic is a section referred to as the reference voltage supply 116. The reference voltage supply 116 uses a reference diode U19 which is semi-adjustable with the potentiometer R13. The resistor R12 provides bias current going out to the +12 volt bus, also referred to as rail, and filtration by capacitor C5 aids in keeping the signal very quiet. The signal is buffered by U2 and a reference voltage of +2.55 volts is provided. It is important that the reference voltage be precise, and that is the reason for including the potentiometer R13 for trimming the reference voltage. This is one of the parameters set at the factory by utilizing a volt meter positioned at test point A. The next stage of the referenced voltage function 116 is a unit to gain function provided by U2 which inverts the signal so as to provide an accurate −2.55 volts.

The temperature signal from the temperature sensor 62 is passed through temperature converter circuitry 120 which converts the input to a voltage which is proportional to Fahrenheit. The output is then passed to temperature baseline adjustment circuitry 122 which performs an inversion of the signal and removes 80 degrees of the Fahrenheit temperature so that the signal is balanced around zero volts at 80 degrees Fahrenheit. In other words, the temperature has little or no effect at 80 degrees Fahrenheit and need be compensated for only when above or below 80 degrees. The signal is then passed through temperature corrections circuitry 124 which adjusts the amount of moisture signal correction required for temperature variations. The output of the temperature converter circuitry 120 is interconnected to high temperature indicator circuitry 148 which indicates a high temperature due to wiring or component problems. High temperature indicator circuitry 148 is located in control housing 58. Also, the output from the temperature converter circuitry 120 is passed through inverter and limiter circuitry 128 for switching the polarity of the signal so it is preferably positive as required to cause a proper temperature readout at a meter and for limiting signal change in the negative direction. Signal averaging filtration circuitry 130 is present for assuring that the moisture signal moves slowly and does not fluctuate rapidly.

Figure 6A:
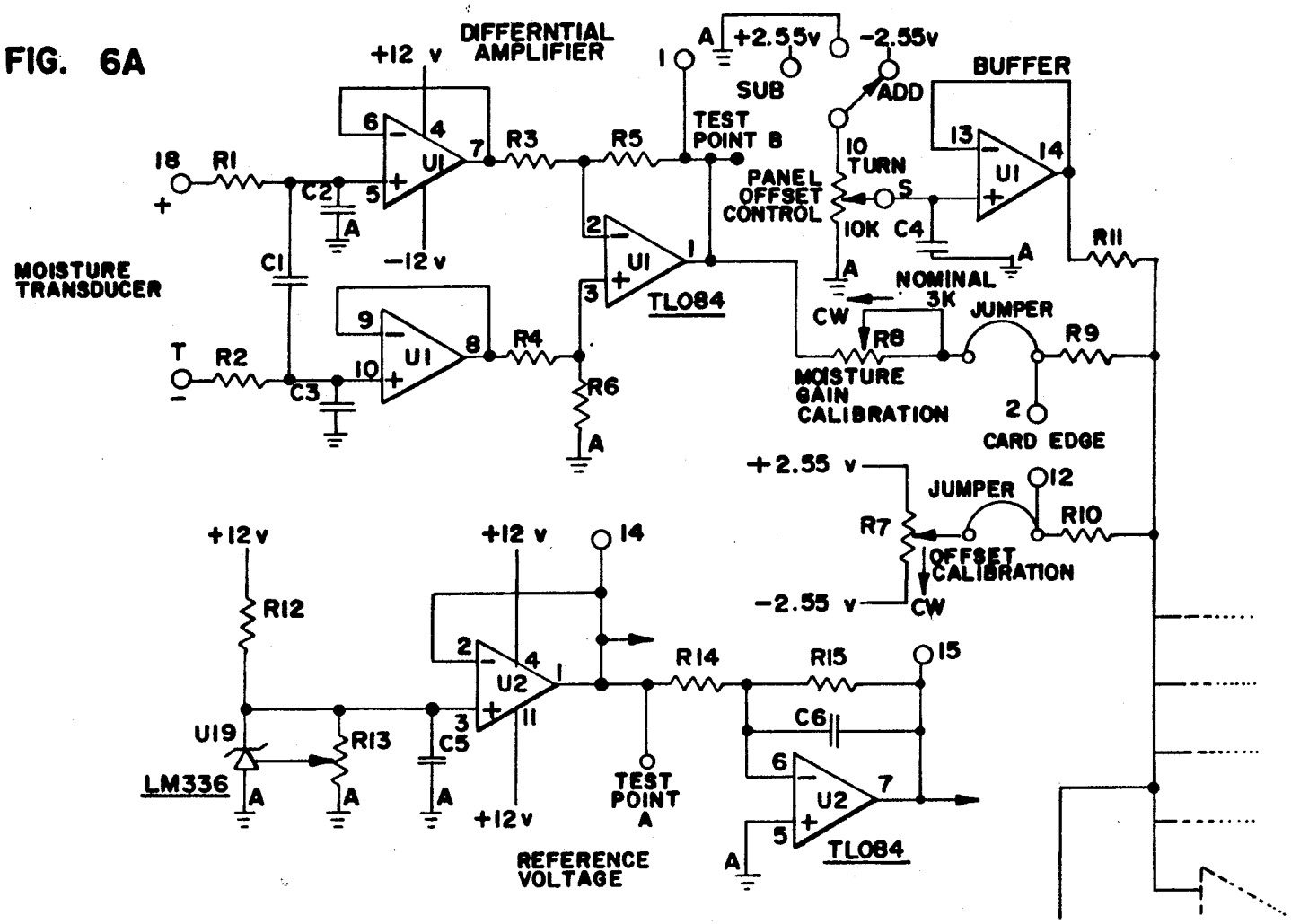
FIGS. 6A, 6B, 6C, 6D, 6E, 6F and 6G are a schematic diagram of an embodiment of a control system in accordance with the principles of the present invention.
Figure 6B:
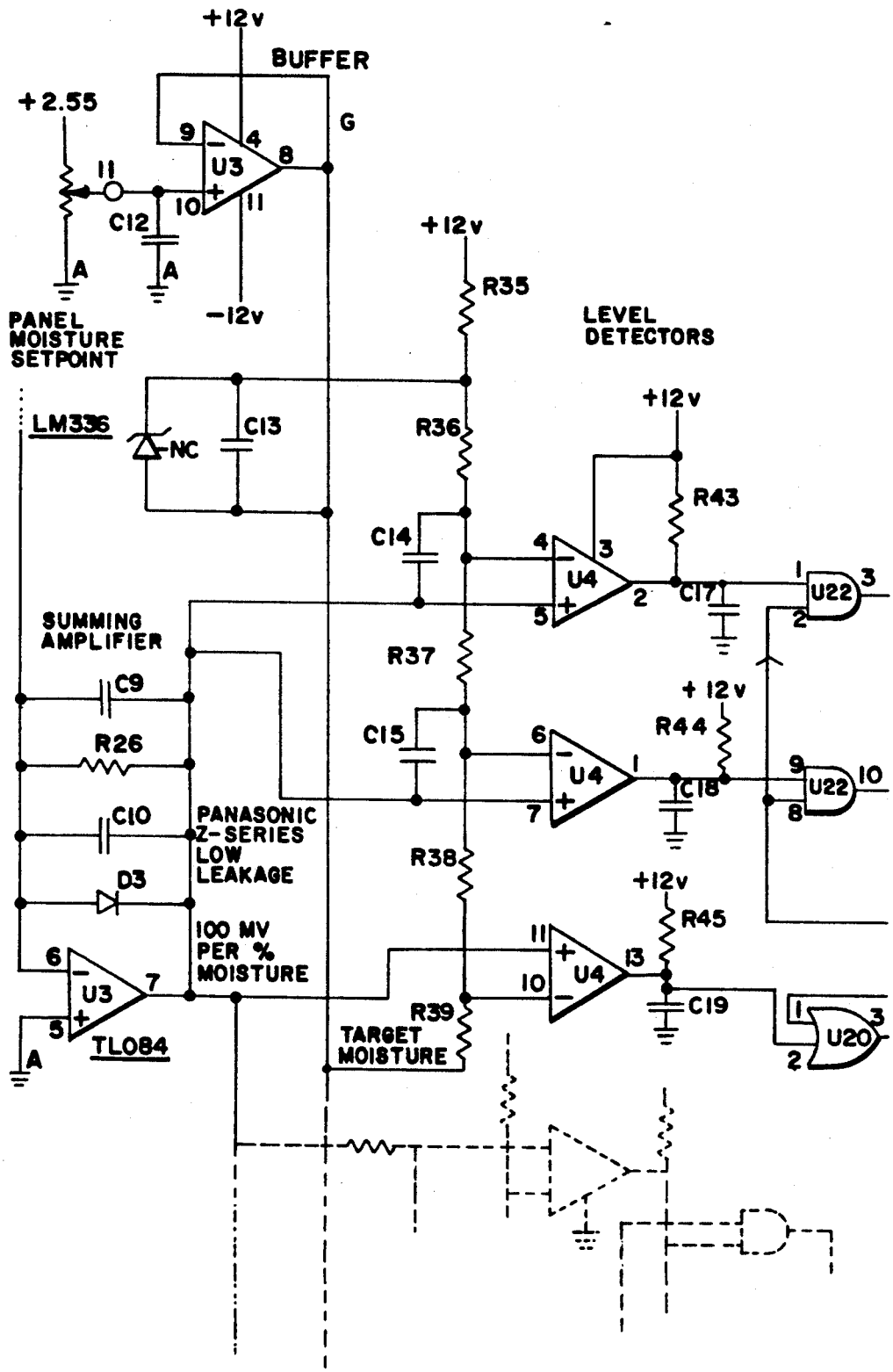
Figure 6C:
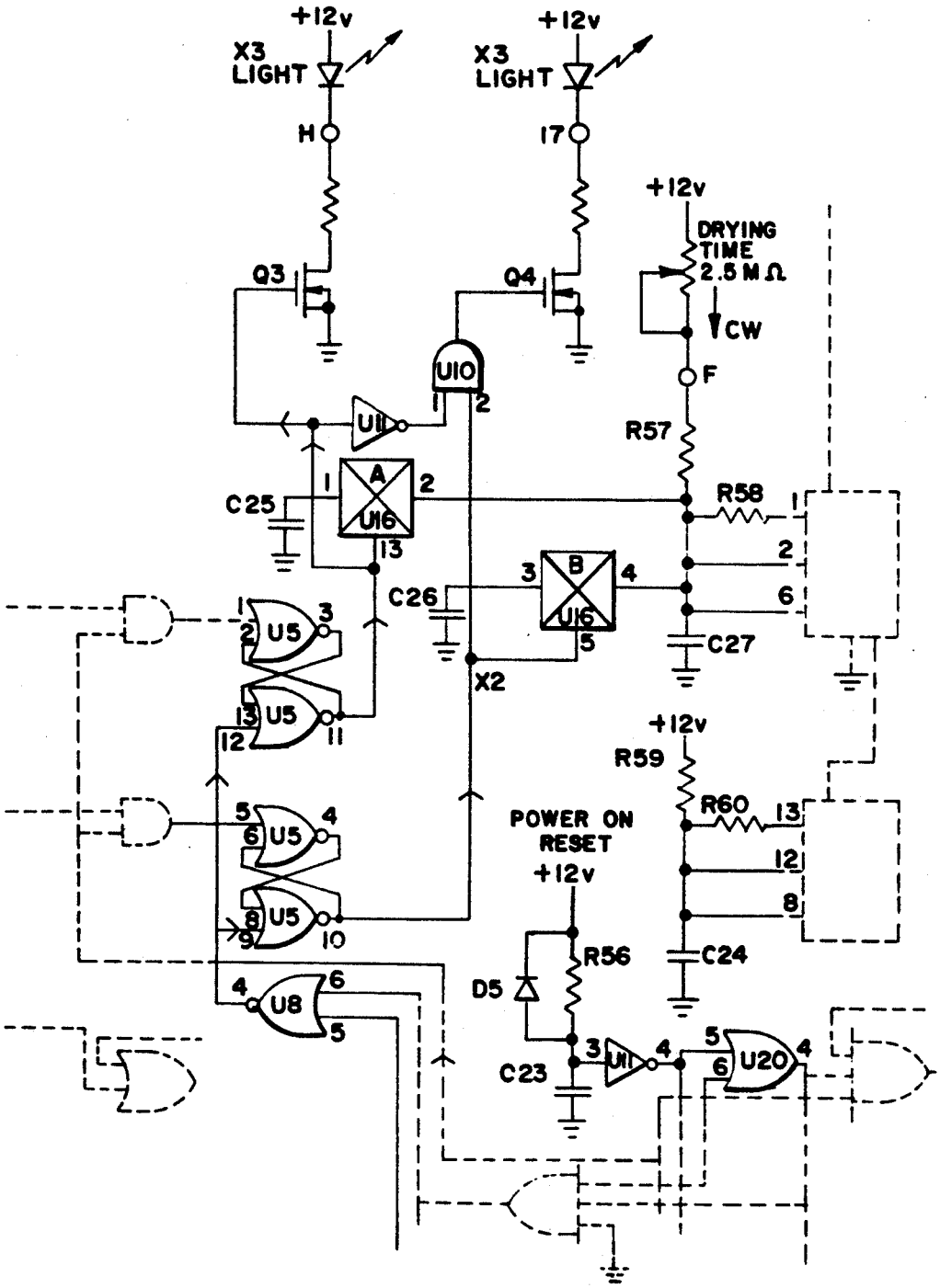
Figure 6D:
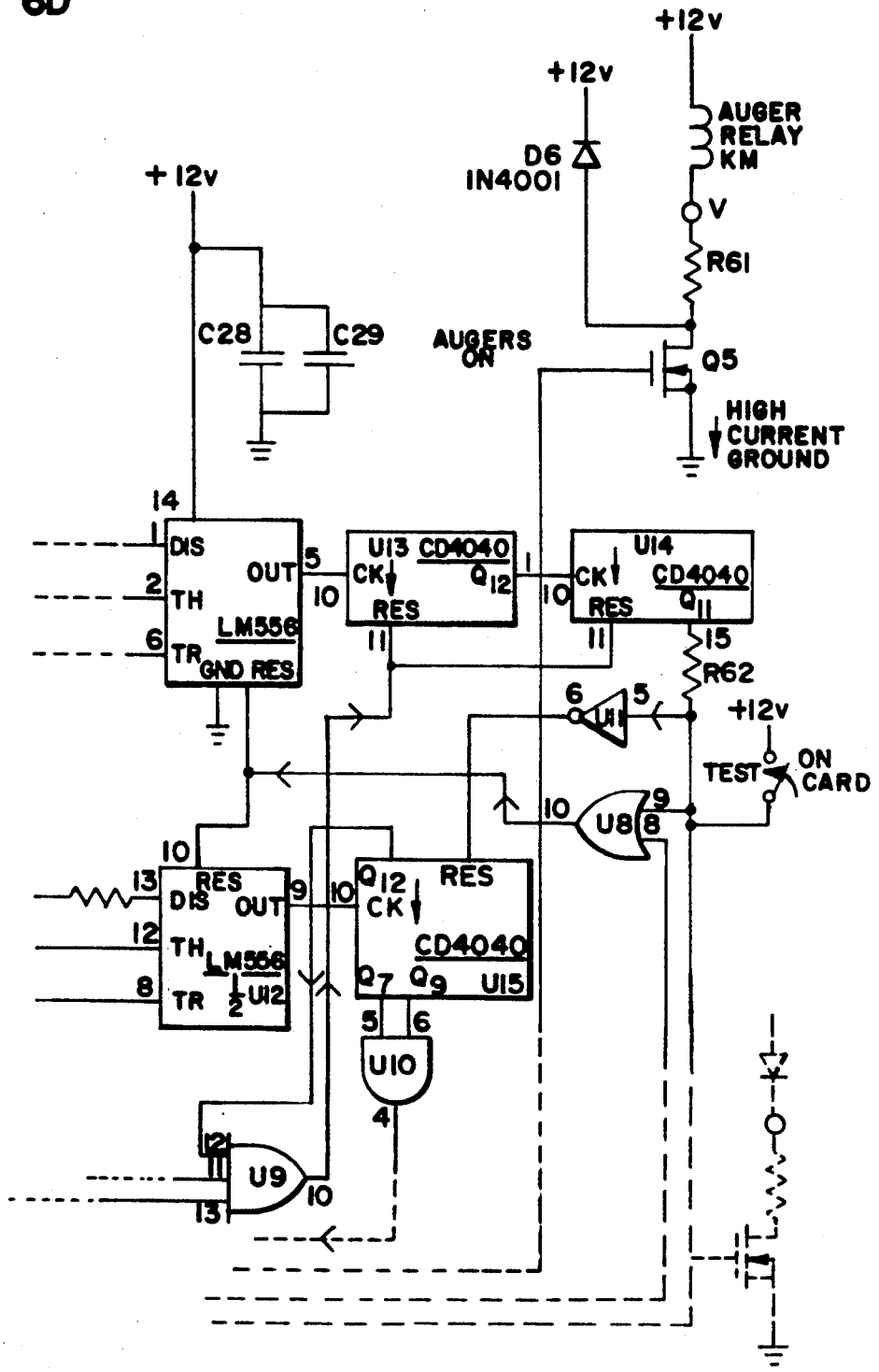
Figure 6E:
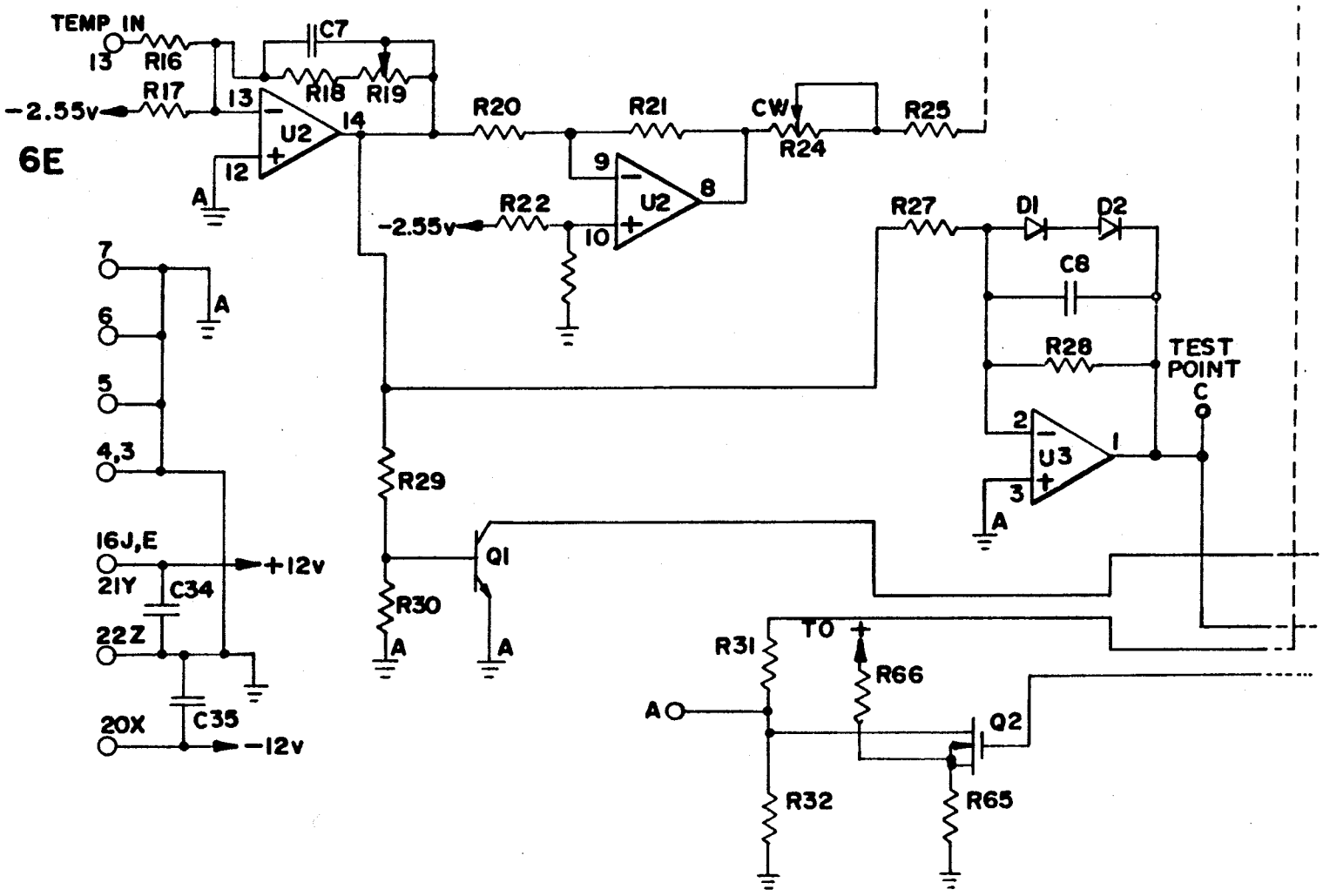
Figure 6F:
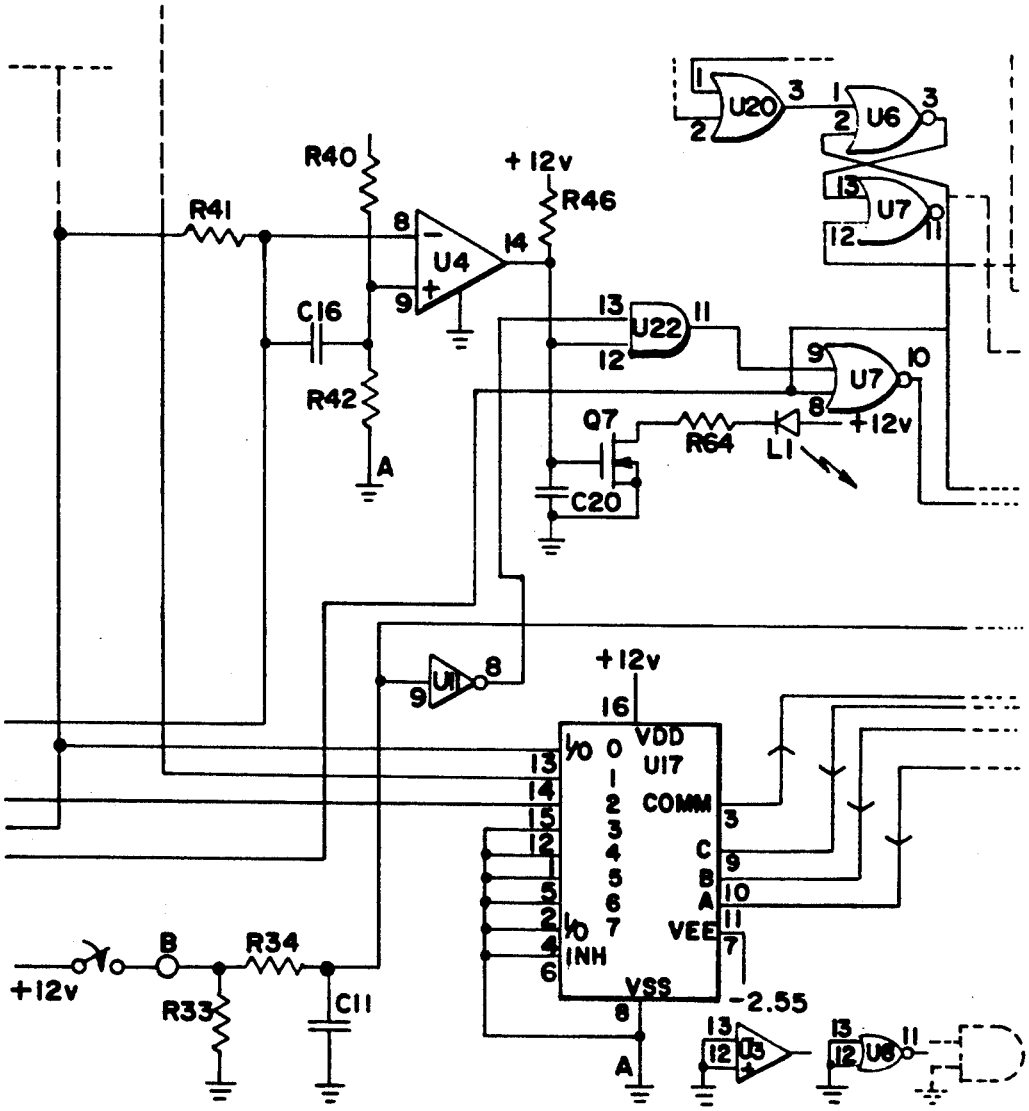
Figure 6G:
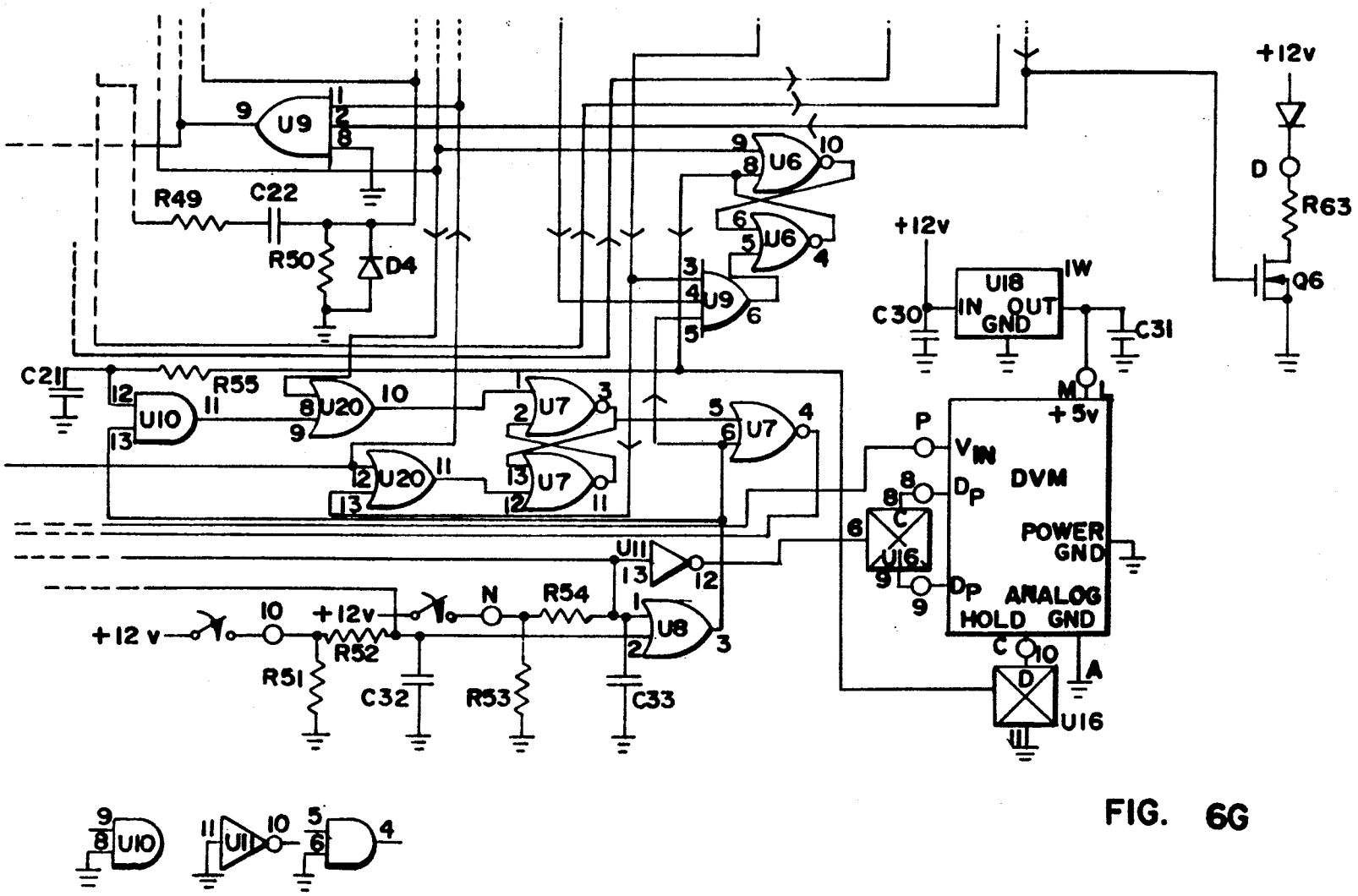

More particularly, as illustrated in the embodiment of FIG. 6E, the temperature convertor function 120 includes an operational amp U2 with a resistor network around it which essentially functions as a summing amplifier to scale and add in an offset to the temperature current coming in from the sensor. The temperature signal comes in on connector pin 13 and goes through resistor 16 which provides for noise reduction. If a volt meter were placed on connector pin 13, one would oberve a voltage proportional to absolute temperature. The amplifier arrangement scales and adds in an offset to create a voltage on pin 14 of the amplifier which is proportional to Fahrenheit temperature which is then transmitted to another operational amplifier U2 which does an inversion and removes 80° of the Fahrenheit temperature such that the signal is balanced around zero volts at 80° Fahrenheit. In other words, at 80° Fahrenheit, the temperature input has no effect on the amplifier. When the temperature deviates from 80° Fahrenheit, the amount of correction required is adjusted by R24 such that if a large amount of correction per temperature was required, R24 would be adjusted to provide a larger compensation or vice versa. A signal branching off from the true Fahrenheit signal voltage branches twice. The signal from the first operational amplifier U2 goes to U3 which provides the signal with the proper polarity for the readout at the meter. In addition, the diodes D1 and D2 prevent the signal from swinging too far so that it doesn't disturb the multiplexer at the bottom center of the schematic.

As a result of all of the input signals into the summing amplifier function 110, the summing amplifier should provide an output which is an accurate representation of the moisture of the grain when the whole unit is calibrated properly. The feedback network above the summing amplifier function 110 comprising diode D3, capacitors C9 and C10, and resistor R26 are additional filtrations so that the output signal from the summing amplifier function 110 will move slowly rather than responding to rapid changes in the moisture signal coming from the sensor and the diodes will function to keep the signal from going negative.

A control panel moisture set point control 140 is used to set the voltage reference for a set of comparators 142,144,146 which will change their output states at the appropriate stage of the drying process. The comparator 146 will switch state at the target moisture set by the control panel moisture set point control 140 plus 0.3 percent. The comparators 142 and 144 will change state at the target moisture plus 2 percent and 1 percent, respectively. The fourth comparator 148 changes states when a transducer fails or if the sensor is not connected properly. The comparator 148 will activate an indicator 150 such as an indicator lamp or the like. Three latches 152,154,156 are interconnected to the comparators 142,144,146 for latching the state of the comparators.

The moisture set point control 140 establishes the moisture level to which the user would like to adjust the control system to dry the grain. As illustrated in FIG. 6B, it sets the voltage reference for a set of three comparators U4 which are labeled level detectors. A resistor chain to the left of these comparators sets up a series of voltages so that the comparators will flip at their appropriate times and their output states will change. The main comparator will switch at exactly the target moisture level +0.3 percent. The two comparators above the main comparator will switch at the target moisture level plus one percent and two percent, respectively. A fourth comparator provides an additional built-in test to indicate a transducer failure or if the sensor is not connected properly. To the right of the comparators are a series of cross-coupled NOR gates which function as the latches 152,154,156. Once triggered by the comparators feeding them, the NOR gates will hold that state until reset. Interconnected to the drying time control oscillator are two analog switches U16 labeled A and B. Capacitors C25, C26, and C27 facilitate creation of the ×2 and ×3 drying conditions. The capacitors are switched in by the switches A and B to slow down the oscillator and cause a longer time-out in the logic.

A multiplexer 160 is interconnected to a digital volt meter readout 162 at the control panel 59. The control lines A,B,C set which feature is to be displayed at the readout 162; A=temperature, B=moisture, and C=moisture set point. Moisture readout is provided at the digital volt meter readout 162 while the system is operating. In the embodiment shown, the digital volt meter (DVM) requires its own 5 volt regulator. Analog switches are present to accommodate the input requirements of the meter for control. Temperature is displayed by use of a control panel read temperature control 164, which in the preferred embodiment is a push button 164, and moisture set point is displayed by use of a control panel read moisture set point control 166, which in the preferred embodiment is a push button arrangement. Both of these controls are provided at the control panel 59. To display the temperature or the moisture set point, the respective control button 164,166 is pushed.

The control system 100 includes a control logic 180 for controlling the sequence of events and timing of the various drying periods and sample runs of the discharge auger assembly 30. The control logic does the decision making as to what drying time extensions should be made based on the moisture that is read at the end of a sample run. User control of the drying time is provided by a control panel drying time potentiometer control 182 which controls timer circuitry 184 and associated counter chain circuitry 186. After a predetermined drying time, the control logic 180 will activate a sample timer 188, as well as an auger relay 192 which will, in turn, activate the discharge auger assembly 30. At the end of a predetermined period of time, the control system will take a sample moisture reading. Based on that moisture reading, the control logic 180 will make decisions based on what the next drying time extension should be or if the grain is sufficiently dry at the end of the sample time, the control logic will continue to discharge the grain until the moisture content exceeds the moisture set point or limit. The sample timer 188 will ensure that the sample run lasts for a predetermined period of time so as to avoid the problem of the discharge auger assembly 30 rapidly switching on and off as the moisture sensor alternately senses grain which is dry and wet. The discharging process might continue for the entire bin of grain or for a very few moments after the sample run is finished In a preferred embodiment, measurement of the grain moisture content continuously occurs as the grain is being discharged. When the moisture content is detected above the moisture set point value, the discharge auger assembly will be shut off for the selected drying time and a sample run is then initiated.

Also illustrated in FIG. 6E is a diagrammatic illustration of the power and ground system The control system 100 operates on + and −12 volts from an external open frame power supply. There is a center point grounding system to reduce the amount of noise present on the low level signal, and there are a couple of capacitors C34,C35 which reduce the noise on the actual circuit card to a minimum. This might be signal noise picked up in the wires between the power supply and the actual card where the control circuitry is located. This also provides a very low/high frequency impedance to all the integrated circuits on the circuit card.

Also illustrated in FIG. 6D is a schematic view of the circuitry associated with the auger relay 192. The auger relay 192 is driven by a MOSFET transistor Q5. When the transistor Q5 turns on, it acts like a switch to ground. The auger relay 192 shown is an inductive, coiled type relay. Diode D6 limits the amount of voltage feedback when the relay is turned off. Resistor R61 is present to keep the transistor from being destroyed in the event that someone inadvertently shorts the relay out and prevents a potential burnout of the circuitry and control card in such an event.

The control system 100 has various indicator lights indicating the drying time or period. If the control logic 180 decides to double or triple the drying time interval, switches 196 and 198 are set respectively and corresponding indicator lamps 200 and 202 are lit at the control panel 59. An indicator lamp 204 is also provided for indicating when the sample run is occurring. Control panel manual controls 206 are provided for manually activating the discharge auger assembly 30. It will be appreciated that the control system might be configured and arranged to have any number of different drying time intervals.

Illustrated in FIG. 7 is a frontal view of an embodiment of the control panel 59. In addition to controls previously discussed, the control panel includes a switch 210 for placing the control system in a manual mode or an automatic mode of grain flow. In the manual mode, the grain flow is made to occur regardless of the moisture content. The digital meter 162 will display one of the following:

1. Moisture of the grain when unit is running.
2. Grain temperature when the temperature button 164 is pressed.
3. Moisture set point when the moisture set point button 166 is pressed.

The moisture offset control 112 is used to select whether the offset will be in the off position or add to or subtract from the moisture readout. The amount of the offset is then dialed in at the control 113 and that amount is displayed at the control 115.

The bottom portion of the control panel includes a fuse 214 and an on/off switch 216 and corresponding indicator light 217. In addition, in the preferred embodiment shown, there are three switches 206 for switching the relay augers off, into manual mode, or into automatic mode.

As discussed above, the signal processing applied to the sensor signal before display at the readout 162 includes low pass filtration. This has the effect of averaging out short term variations in grain moisture as a sample of grain passes the sensor and also it substantially eliminates any electrical noise picked up outside the control housing 58. Another effect is to smooth out variations in the signal due to moving parts near the sensor, such as auger blades and shafts. This filtration is essential to reliable operation of the moisture decision comparator circuits which eventually control the discharge augers. The filtering is done twice; immediately upon entering the control housing 58 by the action of R1, R2 and C1 and then again by the feedback capacitor C10 on the summing amplifier. The overall effect is that of a second order low pass filter. The second order filter can accomplish more signal smoothing than a simple first order filter for any given transient response time. The drying time adjustment is accomplished by using a resistance controlled oscillator and a counting chain. This allows the accurate control of extremely long times with simple resistor capacitor components. Conventional approaches to generating time-outs this long would require extreme component values; large capacitors and large resistances. Most large capacitors are inherently inaccurate and sometimes leaky so that there use here would be troublesome. The sample timer uses a similar technique to accomplish a two-minute item out accurately. The ×2 and ×3 modes of extending drying time are accomplished by switching in additional capacitors on the oscillator node. This slows down the frequency of oscillation and thereby increases the time required to reach the terminal count in the logic. The decision as to when to extend drying time is accomplished by the top two comparators of U4 in the center of the schematic. The resistor chain R35 through R39 forms a series of voltages with various offsets of target moisture voltage at pin 8 of U3. These voltages check up and down with the target moisture control U4 pin 1 will switch when moisture exceeds target by 1 percent and U4 pin 2 will switch at target moisture plus 2 percent. The signals are ignored by the latches following them except during a brief interval at the end of a sample discharge when the moisture reading is assumed to be valid. If one or two percent over moisture set point is indicated at this time, then the condition will be remembered by the ×2 and ×3 latches throughout the following drying cycle. The latches directly control a pair of analog switches which add capacitance to the drying time oscillator node as described above and thereby extend the drying interval.

The user offset control is a front panel potentiometer which allows the user to fine tune the accuracy of the unit, so that it will correspond to other systems such as a grain co-op. It operates in parallel with the internal factory offset calibration. Both circuits inject current into the summing junction of the main summing amplifier. The ten-turn potentiometer provides an accurate fraction of the reference voltages (plus or minus according to the add/subtract switch) to the input side of the resistor R11. The resistor value of the reference voltages are such that full scale rotation of the potentiometer will cause plus/minus one volt variation at the output of the summing amplifier. This corresponds to plus/minus 10 percent of the moisture readout correction.

The control system employs a temperature compensation scheme so that moisture indications will not vary with ambient temperatures. This is accomplished by sensing grain temperature with a separate temperature blade, also referred to as a metal flag, and integrated circuit temperature sensor and then adding a portion of the temperature signal into the moisture summing amplifier in such a way to cancel any temperature-caused errors in the capacitance based moisture signal. This is an empirical process where various grains are tested over temperature and their temperature coefficients (as measured through capacitance) are determined. Once known, these factors can be subtracted out in real time by the compensation circuitry. Strategy is to make baseline measurements at 80 degrees Fahrenheit and to apply no compensation there, but to apply deviations from 80 degrees Fahrenheit. In this way, temperature effects are eliminated to a first approximation over a large range of operating temperatures.

In use, the user will set the moisture level desired by pushing the set moisture limit button 166 and turning the moisture limit adjustment control 140 to the desired moisture level. Digital panel meter readout 162 will display the selected moisture level as the moisture limit adjustment control 140 is turned and the set moisture limit button 166 is pressed. The user will set the auto/-manual switch 210 to the automatic mode. If the user wishes to read temperature, the user will push the temperature button 164 and the temperature will be displayed in the digital volt meter readout 162. The user will turn the drying time potentiometer control 182 to the desired drying time between samples. In the preferred embodiment, the user can select a drying time between 15 and 60 minutes. If the control logic 180 determines that the drying time needs to be multiplied by 2, the indicator 200 positioned in a concentric circle about the selected drying time parameters will light indicating that the drying time has been doubled. If the control logic 180 determines that the drying time should be tripled, the indicator lamp 202 concentrically positioned about the selected drying time scale will be lit. By observing which of the concentric rings is lit, the operator can tell the drying time which is selected. The drying time potentiometer control 182 will include a knob 181 with suitable indicia indicating the drying time selected. If the user wishes to offset the moisture level indicated in the digital volt meter readout 162, the user can set the moisture offset control 112 to the subtraction or the addition state from an off state and then dial in the selected offset by use of the control 113. The offset will be displayed in a readout 115. During a time a sample is being taken, the sample indicator 204 will be lit. The switch 216 is used to switch the control power on and off, the switch 216 including a corresponding indicator 217.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A control system for a drying system of the type which includes a drying bin, means for circulating drying air therethrough, and a discharge auger for removing dried particulate material from the bin, comprising:

(a) discharge particulate material moisture sensing means including a sensor assembly positioned inside of said discharge auger for directly sensing the moisture content of particulate material in said discharge auger, said moisture sensing means including capacitive means; and (b) control means connected to said discharge particulate material moisture sensing means and said discharge auger for controlling operation of said discharge auger.

2. A control system for a drying system according to claim 1, wherein said capacitive means includes adjustable trimmer capacitor means for providing an adjustable reference output and sensor capacitor means electrically interconnected to the sensor assembly mounted in said discharge assembly for providing an output representative of the particulate material moisture content, whereby the output of the trimmer capacitor can be adjusted to match that of the sensor capacitor means when there is no particulate material present in the discharge auger so as to provide a reference output.

3. A control system for a drying system according to claim 2, wherein said discharge particulate material moisture sensing means includes voltage amplifier means for amplifying the output of the trimmer capacitor means and the sensor capacitor means.

4. A control system for a drying system according to claim 1, wherein the discharge particulate material moisture sensing means includes voltage regulator means interconnected to a power supply for providing a regulated voltage.

5. A control system for a drying system according to claim 1, wherein the control means includes a first low pass filtration means for eliminating electrical noise.

6. A control system for a drying system according to claim 1, wherein the control means includes a second a low pass filtration means for averaging out short term variations in moisture readings from the discharge particulate material moisture sensing means.

7. A control system for a drying system according to claim 1, wherein said control means includes first comparator means for comparing a moisture reading from the discharge particulate material moisture sensing means to a predetermined moisture limit and for stopping or slowing the discharge auger if the moisture reading is greater than the predetermined moisture limit.

8. A control system for a drying system according to claim 7, wherein the control means includes sample timer means for preventing the first comparator means from stopping the discharge auger for a predetermined time immediately after the discharge auger is started.

9. A control system for a drying system according to claim 8, wherein the sample timer means includes oscillator means and counter chain means.

10. A control system for a drying system according to claim 1, wherein the control means includes adjustable timer means for periodically starting the discharge auger.

11. A control system for a drying system according to claim 10, wherein the control means further includes a second comparator means for determining whether a moisture reading from the discharge particulate material moisture sensing means exceeds a predetermined moisture limit by a predetermined amount.

12. A control system for a drying system according to claim 11, wherein the adjustable timer means includes extension means for automatically extending the time between periodic startings of the discharge auger by a predetermined amount of time for the complete drying time cycle when the second comparator means indicates that the moisture reading exceeds the predetermined moisture limit by the predetermined amount.

13. A control system for a drying system according to claim 12, wherein the adjustable time means includes resistance-controlled oscillator means and counter chain means.

14. A control system for a drying system according to claim 13, wherein the extension means includes additional capacitors on the node of the resistance-controlled oscillator.

15. A control system for a drying system according to claim 1, wherein the control means includes adjustable moisture offset potentiometer means for adjusting a moisture reading from the discharge particulate material moisture sensing means.

16. A control system for a grain drying system according to claim 1, wherein the discharge particulate material moisture sensing means includes temperature sensing means for determining the temperature of the discharged particulate material the temperature sensing means including:

(a) a sensor blade; and (b) an integrated circuit temperature sensor.

17. A control system for a drying system according to claim 1, wherein the control means includes temperature compensation means for eliminating system variations due to temperature different than a predetermined baseline temperature.

18. A control system for a drying system according to claim 17, wherein the temperature compensation means includes:

(a) a temperature converter; and (b) adder means for adding a portion of a temperature signal into a moisture summing amplifier.

19. A control system for a drying system according to claim 2, wherein the control means includes a differential amplifier means for receiving the outputs of said trimmer capacitor means and said sensor capacitor means, whereby any temperature and component variations appearing in both outputs will be eliminated.

* * * * *

UNITED STATES PATENT AND TRADEMARK OFFICE

CERTIFICATE OF CORRECTION

PATENT NO. : 5,144,755

DATED : September 8, 1992

INVENTOR(S) : Keith Braun, Larry Stille

It is certified that error appears in the above-identified patent and that said Letters Patent is hereby corrected as shown below:

In column 2, lines 21 and 31, "disclosed" should read --discloses--;

In column 8, line 67, insert --adjusts the relative relationship between voltage-- after the numeral "110";

In column 9, line 24, "i" should read --in--;

In column 13, line 59, insert --.-- after the word "control";

In column 15, line 58 (claim 6), delete "a" after the word "second";

In column 16, line 53 (claim 17), "temperature" should read --temperatures--.

Signed and Sealed this

Ninth Day of November, 1993

*Attest:*

*Attesting Officer*

BRUCE LEHMAN

*Commissioner of Patents and Trademarks*